US008813499B2

(12) United States Patent
Melhus

(10) Patent No.: US 8,813,499 B2
(45) Date of Patent: Aug. 26, 2014

(54) APPARATUS AND METHOD OF CONVERTING A PORTION OF THE SPECIFIC ENERGY OF A FLUID IN GAS PHASE INTO MECHANICAL WORK

(75) Inventor: Trond Melhus, Sandnes (NO)

(73) Assignee: Home Investering AS, Sandnes (NO)

( * ) Notice: Subject to any disclaimer, the term of this patent is extended or adjusted under 35 U.S.C. 154(b) by 380 days.

(21) Appl. No.: 13/322,645

(22) PCT Filed: May 26, 2010

(86) PCT No.: PCT/NO2010/000191

§ 371 (c)(1),
(2), (4) Date: Nov. 28, 2011

(87) PCT Pub. No.: WO2010/137992

PCT Pub. Date: Dec. 2, 2010

(65) Prior Publication Data

US 2012/0073297 A1 Mar. 29, 2012

(30) Foreign Application Priority Data

May 28, 2009 (NO) ..... 20092085

(51) Int. Cl.

| | |
|---|---|
| ***F01K 13/02*** | (2006.01) |
| ***F01C 21/00*** | (2006.01) |
| ***F01C 1/344*** | (2006.01) |
| ***F01C 21/06*** | (2006.01) |

(52) U.S. Cl.

CPC ..... *F01C 1/3441* (2013.01); *F05B 2210/12* (2013.01); *F01C 1/3446* (2013.01); *F05B 2210/13* (2013.01); *F01C 21/06* (2013.01)

USPC ..... 60/660; 60/670; 418/82; 418/260

(58) Field of Classification Search

CPC ..... F01C 1/344; F01C 1/3441; F01C 1/3446; F01C 21/06; F05B 2210/12; F05B 2210/13; F01K 13/02

USPC ..... 60/643, 645, 660, 670; 418/82, 259, 418/260

See application file for complete search history.

(56) References Cited

U.S. PATENT DOCUMENTS 3,169,375 A 2/1965 Velthuis
3,828,569 A * 8/1974 Weisgerber ..... 62/227

(Continued)

FOREIGN PATENT DOCUMENTS

EP 1 925 776 A1 5/2008
WO WO 02/101203 A1 12/2002

OTHER PUBLICATIONS

European Search Report Corresponding to European Application No. 10 78 0849; Dated: May 3, 2012; 8 Pages.

(Continued)

*Primary Examiner* — Hoang Nguyen

(74) *Attorney, Agent, or Firm* — Myers Bigel Sibley & Sajovec, P.A.

(57) ABSTRACT

An apparatus (1) and a method of converting a portion of the specific energy of a fluid in gas phase into mechanical work are described, the apparatus (1) comprising: at least one housing (3, 3') which is provided with at least one gas-supply portion (7, T) and at least one exhaust portion (9, 9')/each of the at least one housing (3, 3') comprising: a blade wheel (5) which is rotatably arranged in the housing (3, 3') and which includes: a shaft (51) enclosed by a drum (53); at least two blades (55) which are movably arranged to the drum (53) so that a portion (57) of the blades (55) is arranged to be moved towards the internal casing surface (31) of the housing (3, 3') in such a way that the drum (53), the internal casing surface (31) of the housing (3) and the blades (55) define chambers (59) arranged to contain gas, an effective area of a blade (55) which is immediately upstream of the exhaust portion (9, 9') being larger than an effective area of a blade (55) which is immediately upstream of the gas-supply portion (7, 7'); that the blade wheel (5) constitutes a barrier between the gas-supply portion (7, 7') and the exhaust portion (9, 9'); and that the exhaust portion (9, 9') of one of the at least one housing (3, 3') is provided with a condenser (11) to condense the gas which has been carried into the exhaust portion (9, 9').

20 Claims, 8 Drawing Sheets

(56) References Cited

U.S. PATENT DOCUMENTS

| | | | | |
|---|---|---|---|---|
| 4,415,320 | A * | 11/1983 | Maruyama et al. | 418/150 |
| 4,486,158 | A * | 12/1984 | Maruyama et al. | 418/39 |
| 5,501,586 | A | 3/1996 | Edwards | |
| 5,537,974 | A | 7/1996 | Palmer | |
| 6,589,033 | B1 | 7/2003 | Johnson et al. | |
| 7,255,546 | B1 | 8/2007 | Del Rio | |
| 8,375,720 | B2 * | 2/2013 | Pekrul | 60/651 |
| 2006/0201156 | A1 | 9/2006 | Pekrul et al. | |

OTHER PUBLICATIONS

International Preliminary Report on Patentability Corresponding to International Application No. PCT/NO2010/000191; Date of Completion: Jun. 29, 2011; 30 Pages.

* cited by examiner

APPARATUS AND METHOD OF CONVERTING A PORTION OF THE SPECIFIC ENERGY OF A FLUID IN GAS PHASE INTO MECHANICAL WORK

RELATED APPLICATIONS

This application is a 35 U.S.C. §371 national phase application of PCT Application PCT/NO2010/000191, filed May 26, 2010. The entire content of this application is incorporated herein by reference.

The present invention relates to an apparatus and a method of converting a portion of the specific energy of a fluid in gas phase into mechanical work.

A large part of the electrical energy produced is provided by means of generators driven by means of steam turbines. The steam that drives the turbines is produced by the combustion of coal, for example. About 40% of all the electrical energy which ins consumed is produced in this way. In addition, electrical energy is produced by means of nuclear reactors which utilize the energy to produce steam, or from so-called gasworks which utilize the exhaust from the combustion of gas to produce steam.

There are several drawbacks related to producing electrical energy by means of steam turbines in accordance with the prior art. The drawbacks relate to the relatively poor utilization of the energy of the fuel in the form of produced current, while at the same time, the equipment required is costly and extensive and requires extensive ancillary systems. Besides, steam turbines must be operated at very high speeds. This is because the suction forces from the underpressure on the vacuum side are used to produce high flow rates, and to capture the largest possible portion of the energy, the turbine wheels must be rotated at a high number of revolutions per minute. Another substantial drawback is that steam turbines require overheated steam to avoid condensation and damaging of the turbine.

A person skilled in the art will know that the efficiency of a steam turbine depends on the throughput of the turbine. The throughput is affected by, among other things, the underpressure which is achieved in a condenser which is connected to the exhaust portion of the turbine. The underpressure, in its turn, is susceptible to the influence of the amount of cooling the condenser may provide.

It is known that modern gasworks use sea water to achieve the best possible cooling of the condenser. For example, gasworks are known that consume 60 $m^3$ of sea water at 4° C. to produce 1 MW of power, wherein the cooling water out of the condenser has a temperature of approximately 14° C. Thus, large amounts of energy go to waste.

Many types of gases will be suitable for use in the apparatus. One of the most relevant gases is water in its gas phase, steam that is. In what follows, the concept of "steam" will be used in addition to gas. However, steam is to be understood also to include any suitable gas.

The invention has for its object to remedy or reduce at least one of the drawbacks of the prior art.

The object is achieved through features which are specified in the description below and in the claims that follow.

According to a first aspect of the present invention, an apparatus for converting a portion of the specific energy of a fluid in gas phase into mechanical work is provided, the apparatus including:

at least one housing which is provided with at least one gas-supply portion and at least one exhaust portion, each of the at least one housing comprising;

a blade wheel which is rotatably arranged in the housing and which includes: a shaft enclosed by a drum; at least two blades which are movably arranged to the drum so that a portion of the blades is arranged to be moved towards the internal casing surface of the housing in such a way that the drum, the internal casing surface of the housing and the blades define one or more chambers arranged to contain gas, wherein an effective area of a blade which is immediately upstream of the exhaust portion is larger than an effective area of a blade which is immediately upstream of the gas-supply portion; that the blade wheel constitutes a barrier between the gas-supply portion and the exhaust portion; and that the exhaust portion of one of the at least one housing is provided with a condenser to condense the gas which has been carried into the exhaust portion. The condenser is provided with a controlled outlet in order that vacuum may be provided in the condenser.

By an effective area is meant, in this connection, the component of the area that brings about rotation of the blade wheel. For example, a blade which is oblique relative to the drum surface of the blade wheel (and the internal casing surface of the housing) will have an effective area which is defined by the component of the area projecting perpendicularly from the surface of the drum.

It is an advantage if the effective area of the blade which is immediately upstream of the gas-supply portion is approximately zero. This is achieved by the drum of the blade wheel being as close as possible to the internal casing surface of the housing and by the blade practically not projecting from the drum. The effect of this is that since the effective area is approximately zero, there will be no forces, with the exception of frictional forces, acting against the rotation of the blade wheel.

It is an advantage if the gas-supply portion is provided with a cam grate arranged to guide the blades in such a way that the effective area of the blade will increase gradually through the gas-supply portion.

It is an advantage if the exhaust portion is provided with a cam grate arranged to guide the blade in such a way that the effective area of the blade will be reduced gradually through the exhaust portion. This has the effect of the blades being carried through the exhaust portion and guided into the correct position relative to the internal casing surface of the housing downstream of the exhaust portion.

Trials have surprisingly shown that it is an advantage if a portion of the housing downstream of the exhaust portion is provided with a draining device which communicates with the exhaust portion in such a way that any fluid entrained by the blades from the exhaust portion towards the gas-supply portion may be drained into the exhaust portion. In one embodiment, the draining device is formed by one or more grooves in the casing portion of the housing.

It is an advantage if the cam grates and the draining device in the housing are oblique relative to the moving direction of the blades, so that possible wear on the blades will be evenly distributed and grooving from wear is avoided. It will be understood that oblique cam grates and the grooves in the housing are an advantage only in the cases in which the blades abut against the internal casing surface of the housing and the cam grates. If the blades are guided at a small distance from the internal casing surface of the housing and the cam grates, wear will not be relevant. By a small distance is meant a distance which is typically less than 0.05 mm. Such a distance can be achieved by means of magnetic forces, for example, wherein the housing and the end portion of the blades are magnetized with the same polarity. In addition, the magnetic field that arises will have a sealing effect against fluid leakage between the blades and the housing.

It is an advantage if the effective area of the blades is at its largest when the blades are immediately upstream of the exhaust portion, and at its smallest when the blades are in a portion defined by a downstream side of the exhaust portion and the gas-supply portion.

In one embodiment, the effective area of the blades increases continuously from immediately upstream of the gas-supply portion to immediately upstream of the exhaust portion. Alternatively, the effective area of the blades increases stepwise from immediately upstream of the gas-supply portion to immediately upstream of the exhaust portion.

By increasing the effective area of the blades continuously from immediately upstream of the gas-supply portion to immediately upstream of the exhaust portion, the volume of the chamber which is defined between two blades, the external surface of the drum and the internal casing surface of the housing will increase as the blade wheel rotates. This means that there will be a pressure difference between two successive chambers, so that the resultant force acting on each blade will be positive, seen in the direction of rotation.

In one embodiment, the apparatus according to the first aspect of the invention includes two or more housings which are arranged in series. The exhaust portion of the last housing in the series of the two or more housings is connected to the condenser to provide condensation of the gas at the outlet of the apparatus. Through such an arrangement, the energy of the gas may be extracted in steps through the two or more housings of the apparatus.

Alternatively or in addition to the provision of two or more housings in series as described above, two or more housings may be arranged in parallel, wherein the exhaust portion of a first housing is connected to the gas-supply portions of two following housings.

In an apparatus according to the present invention provided with several blades which provide several chambers altogether, the differential pressure that arises as the gas expands, may be utilized throughout the expansion from the gas-supply portion to the exhaust portion.

The underpressure in the condenser will always pull at the largest possible area as long as the blade has its largest area at the condenser.

By providing an apparatus which is "tight" (that is to say, is provided with one or more barriers) between the pressure side and the vacuum side, the forces that arise at the phase transition from gas to liquid, so-called "collapse forces" in the condenser, can be controlled. This can be achieved in several ways. One of them is the dosing-in of a certain amount (volume) of gas which has a certain pressure so that the desired differential pressure is achieved between the gas in the last sector before the condenser and the condensed gas in the condenser. Another way of controlling the collapse forces is by providing the apparatus with a control device which is arranged to adjust the rotational speed of the blade wheel so that the flow rate of the gas through the apparatus can be adjusted in relationship to the capacity of the condenser.

The rotational speed of the apparatus may, with advantage, be influenced by means of a load which is connected to the shaft of the blade wheel. The load may be an electric generator, for example.

Yet another way of controlling the collapse forces is by providing the apparatus with a temperature controller which is arranged to influence the temperature of the gas which is supplied to the apparatus in such a way that the gas does not go through a phase transition from gas to liquid, collapses that is, before arrival at the condenser, but does not have a "residual temperature" that will require extra cooling in the condenser either.

Still another way of controlling the collapse forces is by providing the apparatus with a controller which is arranged to influence the cooling capacity of the condenser.

It has turned out to be advantageous if the apparatus is provided with a control algorithm arranged to control an energy production from the apparatus, wherein the control algorithm is arranged to influence one of or a combination of: the temperature and/or pressure of the supply gas; the rotational speed of the blade wheel; the cooling capacity of the condenser; the load.

In a second aspect of the present invention, a method is provided for the control of at least the underpressure in an exhaust portion of an apparatus which is arranged to convert a portion of the specific energy of a fluid in gas phase into mechanical work, the method including:

- supplying the apparatus with a gas through a gas-supply portion;
- providing a substantially fluidtight, rotating barrier between the gas-supply portion and the exhaust portion; and
- controlling at least the underpressure in the exhaust portion of the apparatus.

The underpressure in the exhaust portion of the apparatus may be controlled by means of, for example, the rotational speed of the rotating barrier in order thereby to adjust the flow rate of the gas through the apparatus to the capacity of a condenser which is arranged for the exhaust portion.

By controlling the rotational speed of the rotating barrier, the amount of energy which is supplied to the exhaust portion may thereby be adjusted to the cooling capacity that might be available in the exhaust portion. Thus, it is possible to avoid an increase in the pressure in the exhaust portion in consequence of too large amounts of energy being supplied, which would result in a considerable reduction in the efficiency of the apparatus.

In one embodiment, the rotational speed of the rotating barrier is controlled by means of a load which is connected to the apparatus. The load may be an electric generator, for example, which is connected to the shaft of the apparatus.

To ensure that as little energy as possible is spent on heat exchange in the condenser, a preferred method includes adjusting the temperature of the fluid which is supplied to the apparatus, so that the temperature of the fluid in gas phase which is carried into the condenser is near a condensing temperature.

It is an advantage if the pressure and/or temperature of the gas which is supplied to the apparatus through the gas-supply portion can be adjusted. By the ability to adjust the temperature of the gas which is supplied to the apparatus, the temperature of the gas which is carried into the condenser can be adjusted to being near a condensing temperature, so that as little energy as possible is spent on heat exchange in the condenser.

It is an advantage if the cooling capacity of the condenser can be adjusted so that the cooling capacity may be adjusted to the amount and properties of the gas which is carried into the condenser.

It is an advantage if the above-mentioned adjustment and control devices are controlled by a superior control algorithm.

There may be more than one apparatus arranged on one common shaft.

In what follows is described an example of a preferred embodiment which is visualized in the accompanying drawings, in which.

Figure 1:
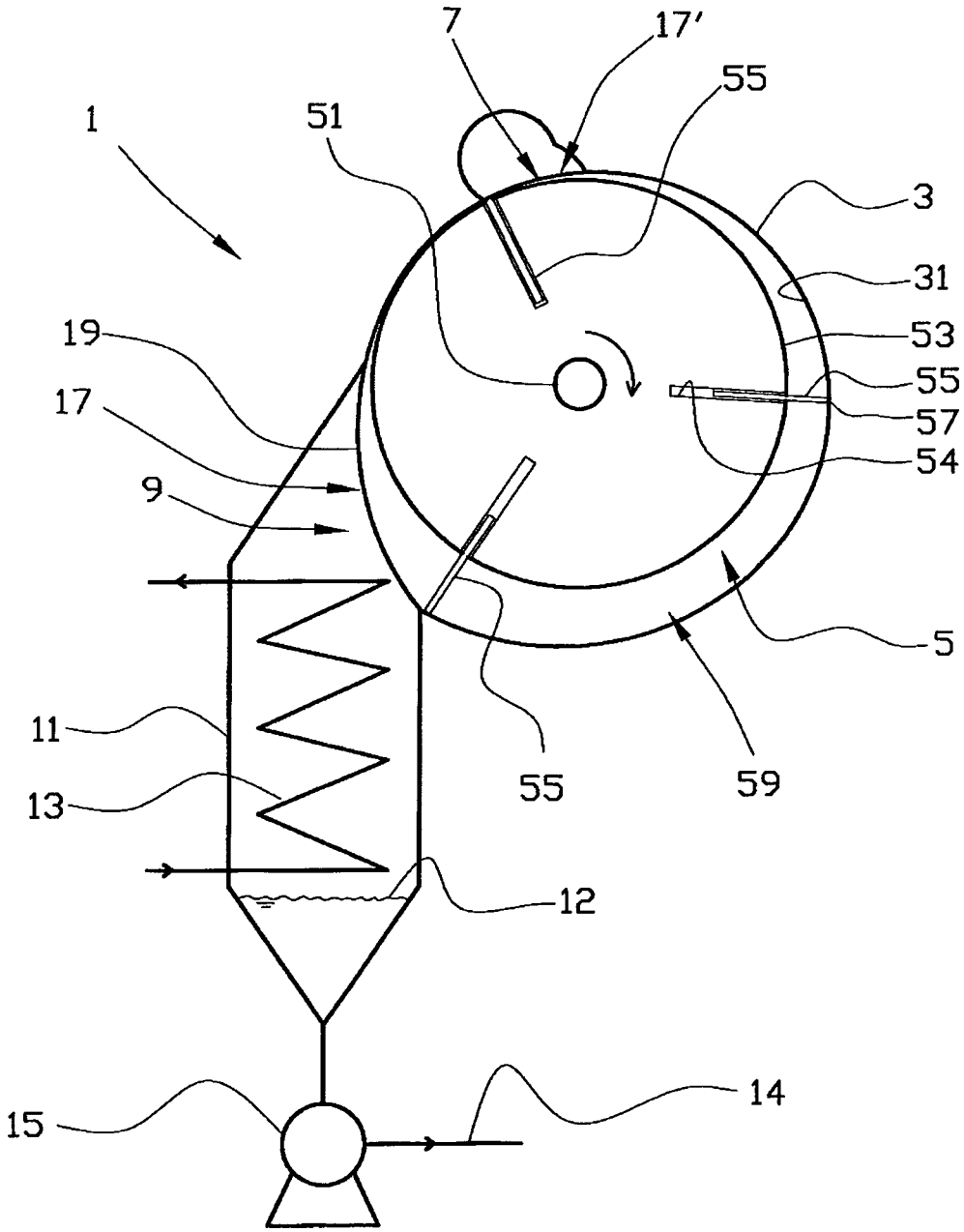
FIG. 1 shows a sectional drawing in a lateral view of a principle apparatus according to the present invention, the apparatus including three blades.

A person skilled in the art will understand that the enclosed drawings are only principle drawings showing main components, and that the housing in FIGS. 1-2 and 5-8 is shown without the necessary end pieces.

In the different figures, like or corresponding components are indicated by the same reference numerals. Thus, an explanation of all the details will not be given in connection with every single figure.

To clarify the explanation of the individual figures, some positional indications are specified, in what follows, by the use of clock-face indications, in which twelve o'clock is up. When the concepts "upstream" and "downstream" are used, it is assumed that the blade wheel is rotating clockwise, as indicated with an arrow in the figures.

In the figures, the reference numeral 1 indicates an apparatus according to the present invention. The apparatus 1 includes at least one housing 3 which encloses a blade wheel 5 which is rotatably arranged in the housing 3. The housing 3 is provided with at least one gas-supply portion 7. At least one of the at least one housing 3 is provided with one or more exhaust portion(s) 9.

The gas which is supplied to the apparatus 1 through its supply portion 7 can be supplied continuously or intermittently. Intermittent supply is achieved by means of a control valve 61 known per se (see FIGS. 5 and 6), which is arranged to be controlled by means of devices known per se, which will be well known to a person skilled in the art.

The blade wheel 5 includes a shaft 51 which is enclosed by a drum 53. At least two blades 55 are movably arranged to the drum 53. An end portion 57 of the blades 55 is arranged to be moved towards the internal casing surface 31 of the housing 3 in such a way that the drum 53, the internal casing surface 31 of the housing 3 and the blades 55, when these are in a position projecting at least partially from the drum 53, define volumes or chambers 59 arranged to contain a gas, for example steam. The gas has been carried into the apparatus through the gas-supply portion 7.

Figure 2:
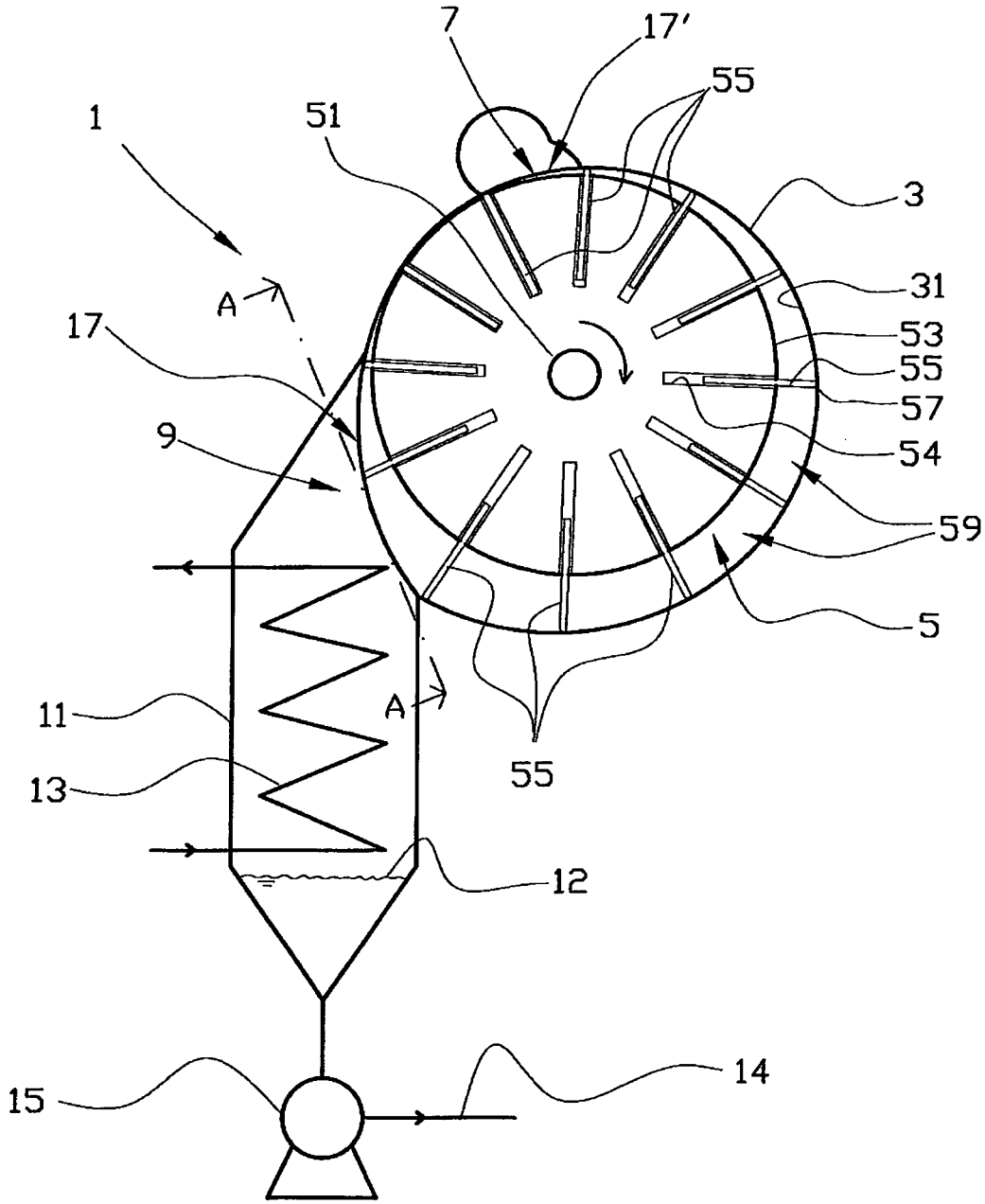
FIG. 2 shows the apparatus of FIG. 1 in an embodiment with twelve blades.

In FIGS. 1 and 2, the housing 3 is provided with two cut-outs or openings. The openings in the housing 3 are provided with the gas-supply portion 7, which is arranged in an upper portion of the housing 3 at about twelve o'clock, and the exhaust portion 9, which extends approximately between seven o'clock and nine o'clock.

The exhaust portion 9 is connected to a condenser 11 which is provided with a cooling device in the form of a pipe loop 13 of a kind known per se. A fluid may be flowed through the pipe loop 13. Alternatively or in addition to the pipe loop 13, the condenser 11 may be provided with a water-mist arrangement (not shown) or other devices suitable for providing cooling in the condenser.

Gas which has been condensed in the condenser 11 is pumped out of it and into a condensate line 14 by means of a pumping device 15. It is vital for the present invention that the condenser is tight so that vacuum may be achieved in the condenser. The pumping device 15 is therefore provided with a not shown control device which controls a liquid level 12 in the condenser 11 so as to form a seal in the bottom portion of the condenser 11.

The only difference between FIGS. 1 and 2 is the number of blades, FIG. 1 showing an embodiment with three blades 55, whereas FIG. 2 shows an embodiment with twelve blades 55. In the embodiments shown, the blades 55 are evenly spaced.

The blades 55 are arranged to move in and out of slots 54 in the drum 53 by means of a control device not shown. In one embodiment, the control device may be constituted by a biasing element, such as a spring device (not shown) which is arranged to drive the blades 55 into abutment against or in the direction towards the internal casing surface 31 of the housing 3. In an alternative embodiment, the control device is constituted by a cam-control device which is arranged to drive the blades 55 into abutment against or in the direction towards the internal casing surface 31 of the housing 3. In yet other embodiments, the blades may be controlled pneumatically or hydraulically. However, the way in which the control of the blades 55 is achieved is not important to the present invention.

In FIGS. 1 and 2, the distance between the drum 53 and the internal casing surface 31 of the housing 3 increases from upstream of the gas-supply portion 7 (at about eleven o'clock in the figures) to an upstream portion of the exhaust portion 9 (at about seven o'clock in the figures).

In an alternative embodiment, the distance increases stepwise between the drum 53 and the internal casing surface of the housing 3 from an upstream portion of the gas-supply portion 7 to an upstream portion of the exhaust portion 9. This means that in one (see FIG. 5) or more portions between the gas-supply portion 7 and the exhaust portion 9, the radius from a centre portion of the shaft 51 to the internal casing surface 31 of the housing 3 is equidistant.

As the blade wheel 5 rotates, gas, for example steam, at a given temperature and a given pressure, which is carried into the apparatus 1 according to FIGS. 1, 2, 6-8 through the gas-supply portion 7 thereof, will expand. This is because the volumes of the chambers 59 which are defined by the internal casing surface 31 of the housing 3, the external surface of the drum 53 and any two successive blades 55, will increase.

The constantly increasing volumes of the chambers 59 will result in the pressure of the gas in each of the chambers 59 constantly being reduced as the gas is carried, while "shut up" in each of the chambers 59, from the inlet portion 7 to the exhaust portion 9. A differential pressure will therefore arise between the gas of any two successive chambers.

The area of the portion of a blade 55 projecting from the drum 53 and defining two successive chambers will practically be equal on both sides. The resultant force which acts on each of the blades 55 present between the gas-supply portion 7 and the exhaust portion 9 will therefore contribute to rotating the drum 53 clockwise. This may also be considered as follows:

By the very fact that the effective areas of the blades 55 defining any chamber 59 between the gas-supply portion 7 and the exhaust portion 9 will be different in the embodiments shown in FIG. 2, for example, and by the very fact that the strain from the gas will be equal on all surfaces in the chamber 59, the force acting on the two blades 55 of the chamber 59 will be different. A differential force will thereby arise, bringing about clockwise rotation of the blade wheel 5 relative to the housing 3.

However, the largest resultant force contributing to rotating the drum 53 will occur at that moment when a blade 55 is moved in over the exhaust portion 9 which is connected to the condenser 11. The gas present in the chamber 59 which is moved in over the exhaust portion 9 and thereby gets "punctured" will collapse immediately. A considerable differential pressure will then arise between the punctured chamber and the following chamber.

The rotational speed is controlled by means of a load (not is shown) which is connected to the shaft 51 of the blade wheel 5. The load may be a generator, for example.

For the expansion cycle between the gas-supply portion 7 and the exhaust portion 9 to be repeated, the blades 55 are driven from their most projecting position at an upstream side of the exhaust portion 9 into their most retracted position at an upstream side of the gas-supply portion 7. This positional change is achieved by means of a cam grate 17 extending through the exhaust portion 9 and by means of a constantly smaller distance between the internal casing surface 31 of the housing 3 and the centre axis of the blade shaft 51 between the exhaust portion 9 and the gas-supply portion 7.

In the embodiments of the apparatus 1 shown, the distance between the external surface of the drum 53 and the internal casing surface 31 of the housing 3 is close to zero in a portion immediately upstream of the gas-supply portion 7. The individual blade 55 passing this portion will practically be completely retracted into the slot 54 in the drum 53.

Figure 3:
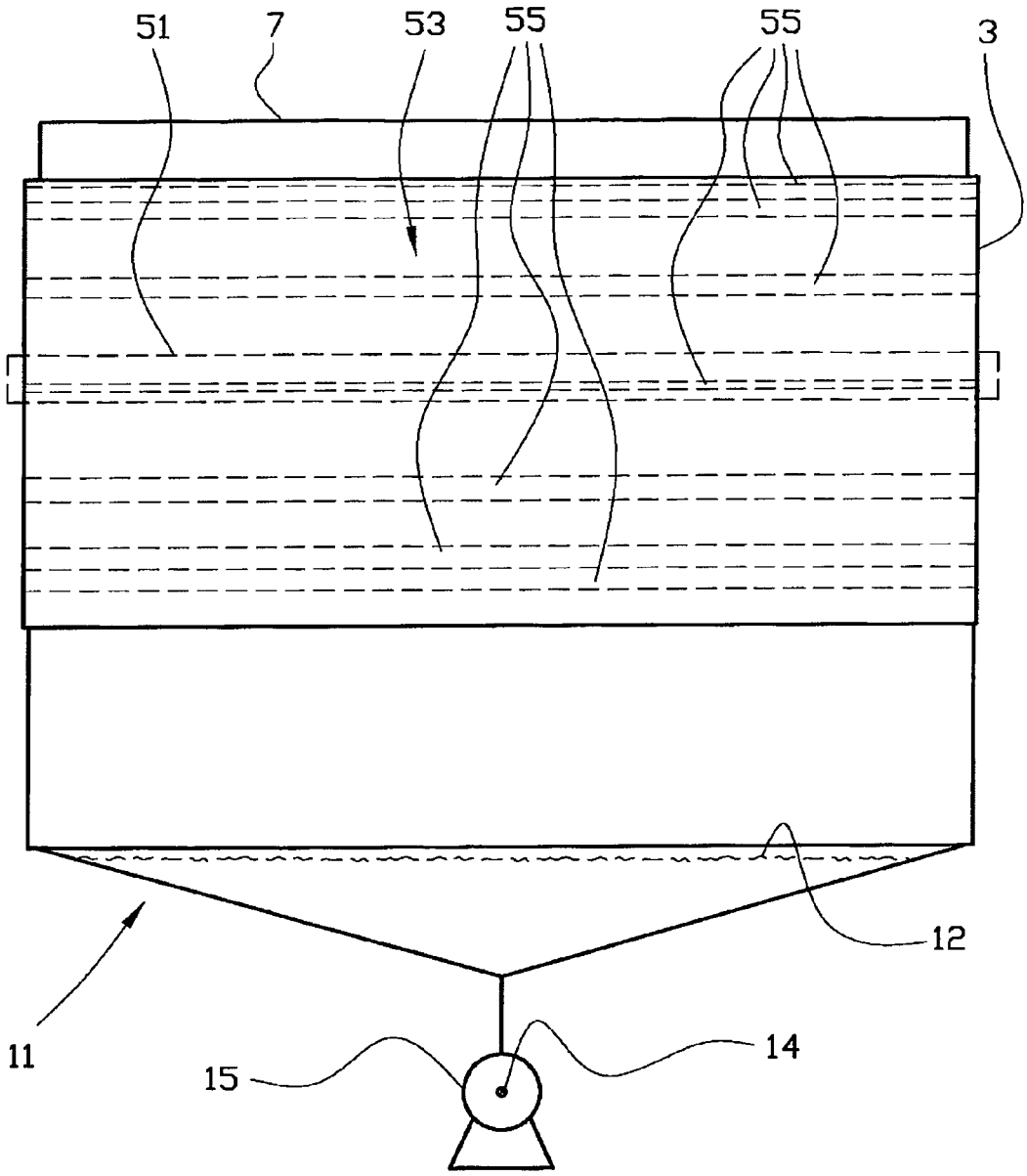
FIG. 3 shows a view of the apparatus of FIGS. 1 and 2 viewed from the right towards the left.

FIG. 3 shows a view of the apparatus of FIG. 2, seen from the right towards the left. As will appear from FIG. 3, in the embodiment shown, the gas-supply portion 7 and the exhaust portion which is connected to the condenser 11 have an extent broadways practically corresponding to the breadth of the blade wheel 5. The blades 55 and the shaft 51 of the drum 53 are shown in dotted lines. The rotational position of the drum 53 relative to the housing 3 corresponds to the rotational position that the drum 53 has in FIG. 2. The pipe loop of the condenser 11 is not indicated in FIG. 3.

Figure 4:
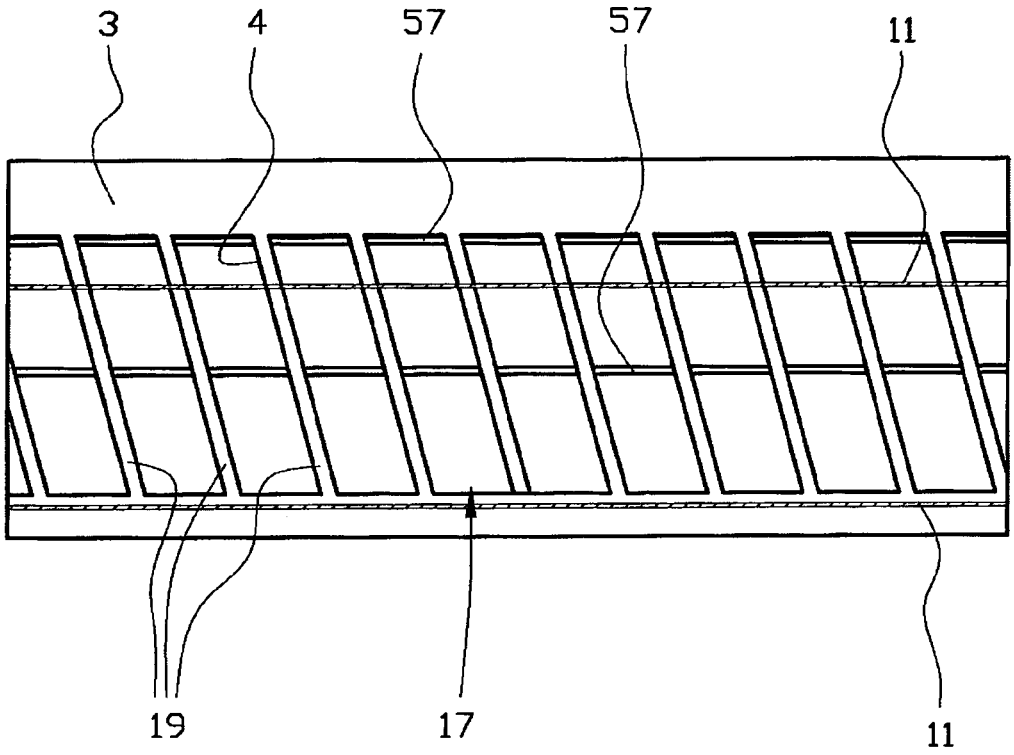
FIG. 4 shows a view seen from A-A in FIG. 2 of a cam grate which is arranged at an outlet portion.

FIG. 4 shows, on a larger scale, a view of the cam grate 17 seen through A-A of FIG. 2. The cam grate 17 includes a plurality of parallel elements 19 extending through an opening 4 in the housing 3 and being spaced in such a way that provisions are made for fluid communication through the opening 4 of the housing 3. The cam grate 17 also provides a guide for the blades 55 so that they are driven from a projecting position at an upstream side of the exhaust portion 9 into a substantially retracted position at a downstream side of the exhaust portion 9 as is shown in FIG. 1, for example. To reduce spot wear on the end portions 57 of the blades 55, the parallel elements 19 of the cam grate 17 are arranged obliquely relative to the moving direction of the blades 55. A corresponding cam grate 17' is arranged at the gas-supply portion 7 of the apparatus 1. However, the cam grate 17' is only indicated in FIGS. 1, 2, 5-8.

It is to be emphasized that the cam grates 17, 17' will not be necessary if the apparatus 1 is provided with a cam-control device, not shown, controlling the projecting position of the blades 55 in a different manner from that of abutment against the internal casing surface 31 of the housing 3.

Figure 5:
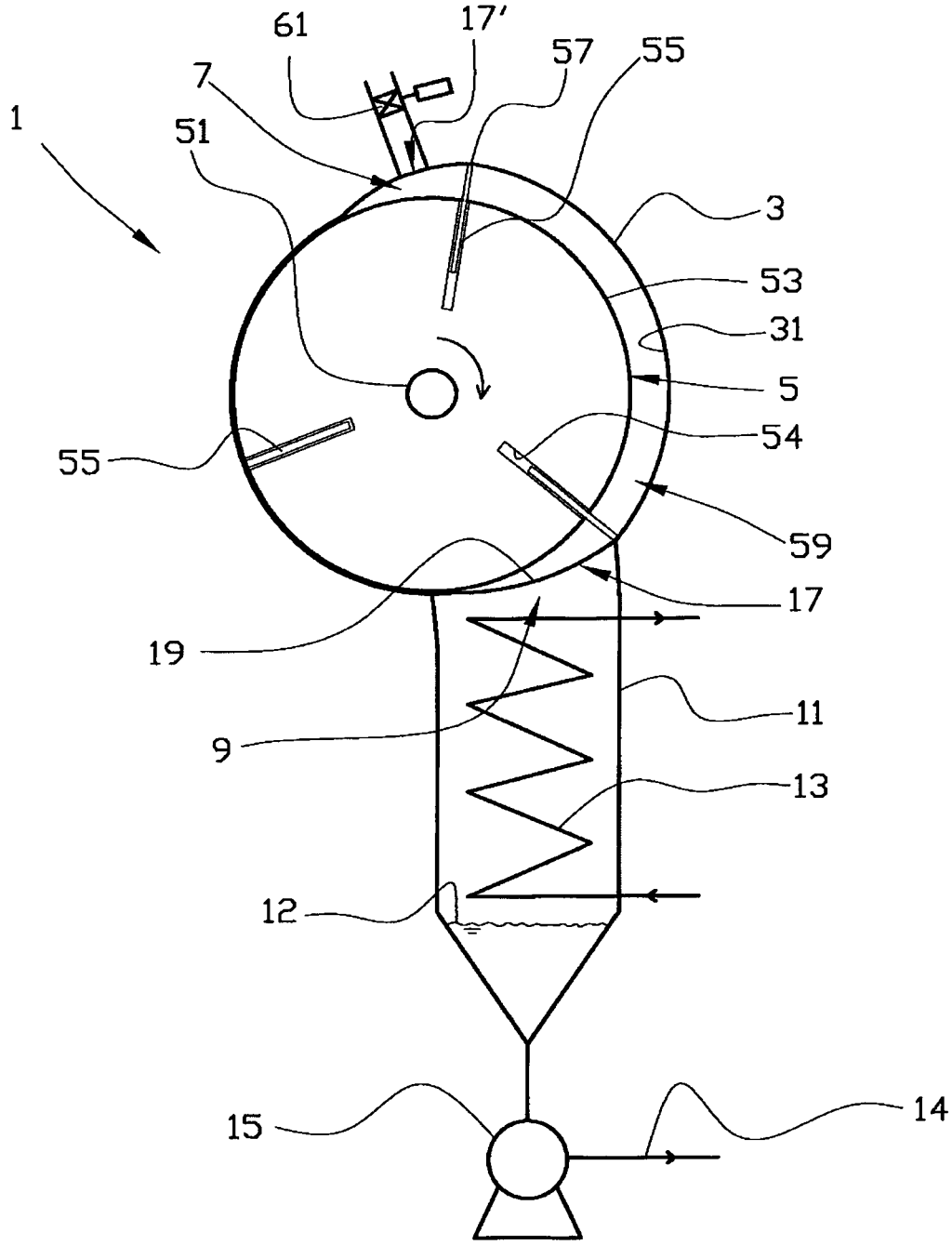
FIG. 5 shows an alternative embodiment of the apparatus shown in FIG. 1.

FIG. 5 shows an alternative embodiment of the apparatus 1, in which the apparatus 1 resembles the apparatus shown in FIG. 1 with the exception of one essential point; between a downstream portion of the gas-supply portion 7 and an upstream portion of the exhaust portion 9, the internal casing surface 31 of the housing 3 is arranged equidistantly from the centre axis of the blade wheel 5. The advantageous features achieved by means of a constantly increasing volume of the chambers 59, as described earlier, will be absent in the embodiment shown. By means of a controlled start-up valve 61, the apparatus 1 may be used as a motor.

Figure 6:
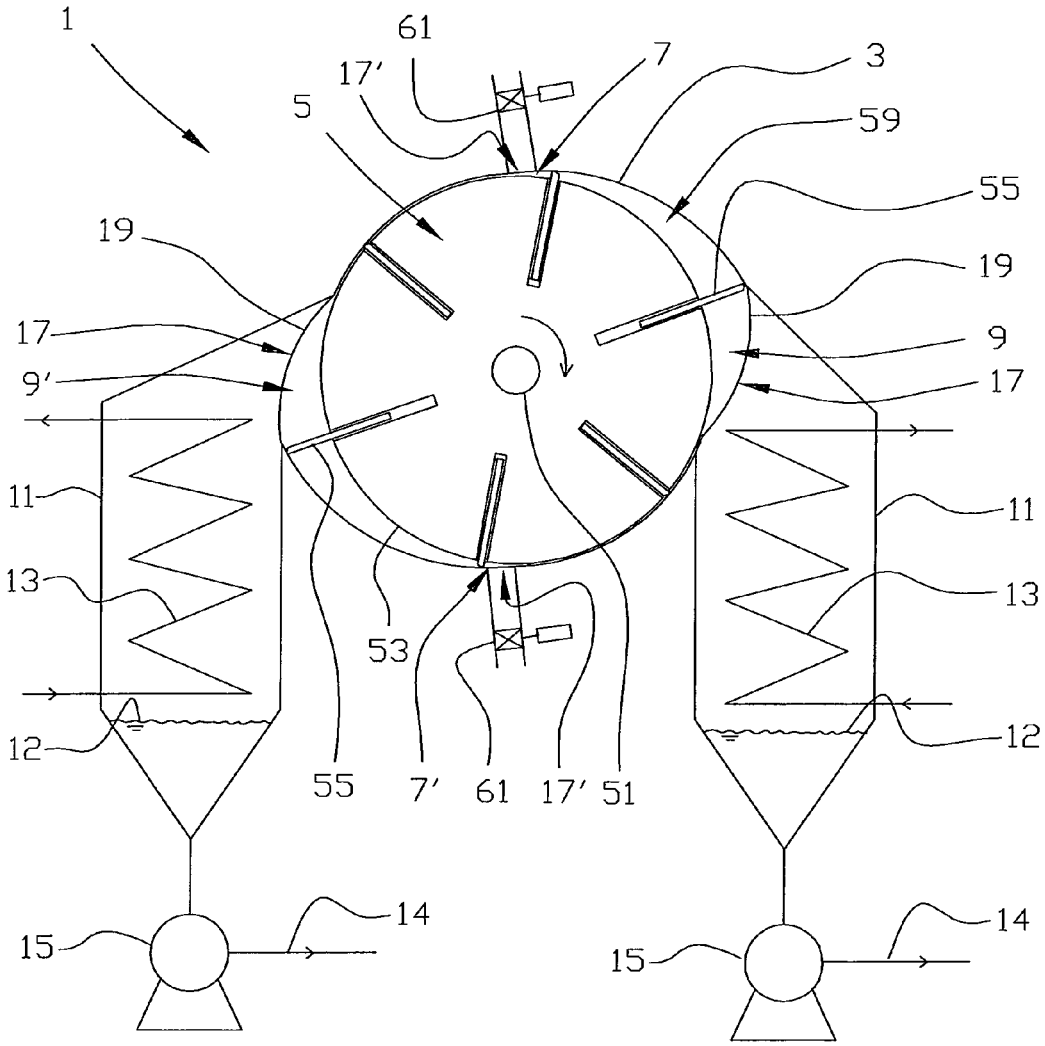
FIG. 6 shows a further alternative embodiment of the apparatus according to the invention, the apparatus being provided with two gas-supply portions and two exhaust portions.

FIG. 6 shows a further alternative embodiment of the apparatuses 1 shown in FIGS. 1, 2 and 5. The apparatus 1 shown in FIG. 6 is provided with two gas-supply portions 7, 7' and two exhaust portions 9, 9'. In the embodiment shown, the gas-supply portions 7, 7' are provided with a controlled start-up valve 61. Otherwise the apparatus 1 is constructed in the same way as the apparatuses shown in FIGS. 1 and 2, but is provided, in the embodiment shown, with six blades 55.

Figure 7:
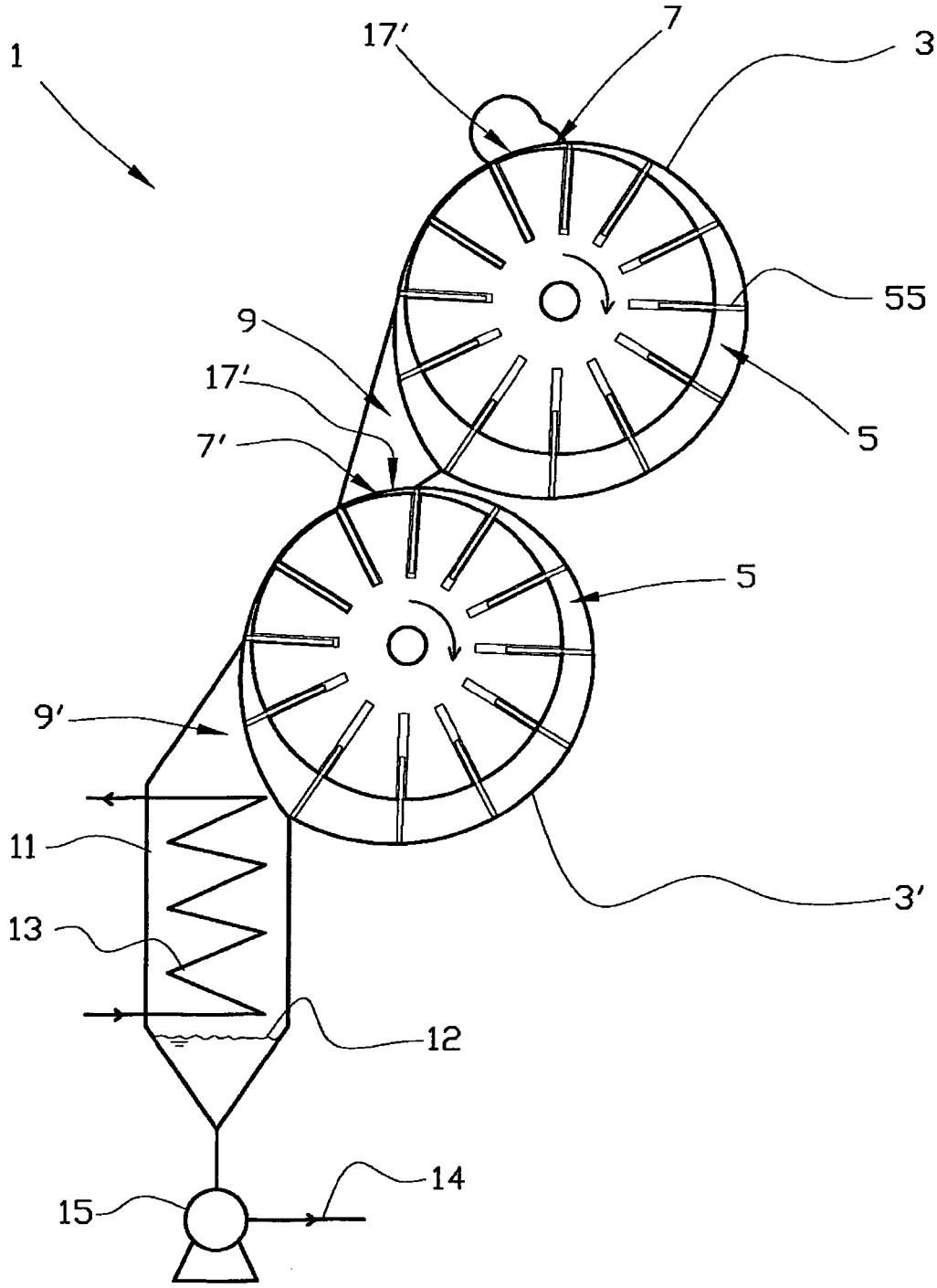
FIG. 7 shows, on a smaller scale, an embodiment of the apparatus according to the present invention, the apparatus including two housings which are arranged in series.

FIG. 7 shows a further alternative embodiment of the apparatus 1 according to the present invention. In FIG. 7, a first housing 3 is connected to a second housing 3' by the exhaust portion 9 of the first housing 3 being connected to the gas-supply portion 7' of the second housing 3'. The exhaust portion 9' of the second housing 3' is connected to a condenser 11 of the kind mentioned above. In the example shown, each of the housings 3, 3' and blade wheels 5 correspond to the housing 3 and blade wheel 5 shown in FIG. 2, but the apparatuses are connected in series. Therefore, for clarity, only some of the elements are indicated by reference numerals in FIG. 7.

In alternative embodiments (not shown), more than two housings 3, 3' can be connected in series and/or in parallel, wherein the last housing or housings 3, 3' of the series is/are preferably connected to a condenser 11.

To be able to adjust the temperature of the gas which is carried between, for example, two housings 3, 3' as shown in FIG. 7, the exhaust portion 9 of the first housing 3 may be provided with a temperature-changing element (not shown). The purpose of such a temperature-changing element is to optimize the temperature of the gas which is carried from the first housing 3 into the second housing 3'. It is thereby possible, on the one hand, to avoid condensing of the gas before it arrives at the exhaust portion of the second housing 3' and, on the other hand, to avoid having unnecessarily high temperature in the gas carried from the second housing 3' into the condenser 11, which requires an extra supply of cooling medium through the pipe loop 13.

It will be understood that any combination of a housing and blade wheel, for example of the kind shown in the rest of the figures, may be connected in series and/or parallel.

Figure 8:
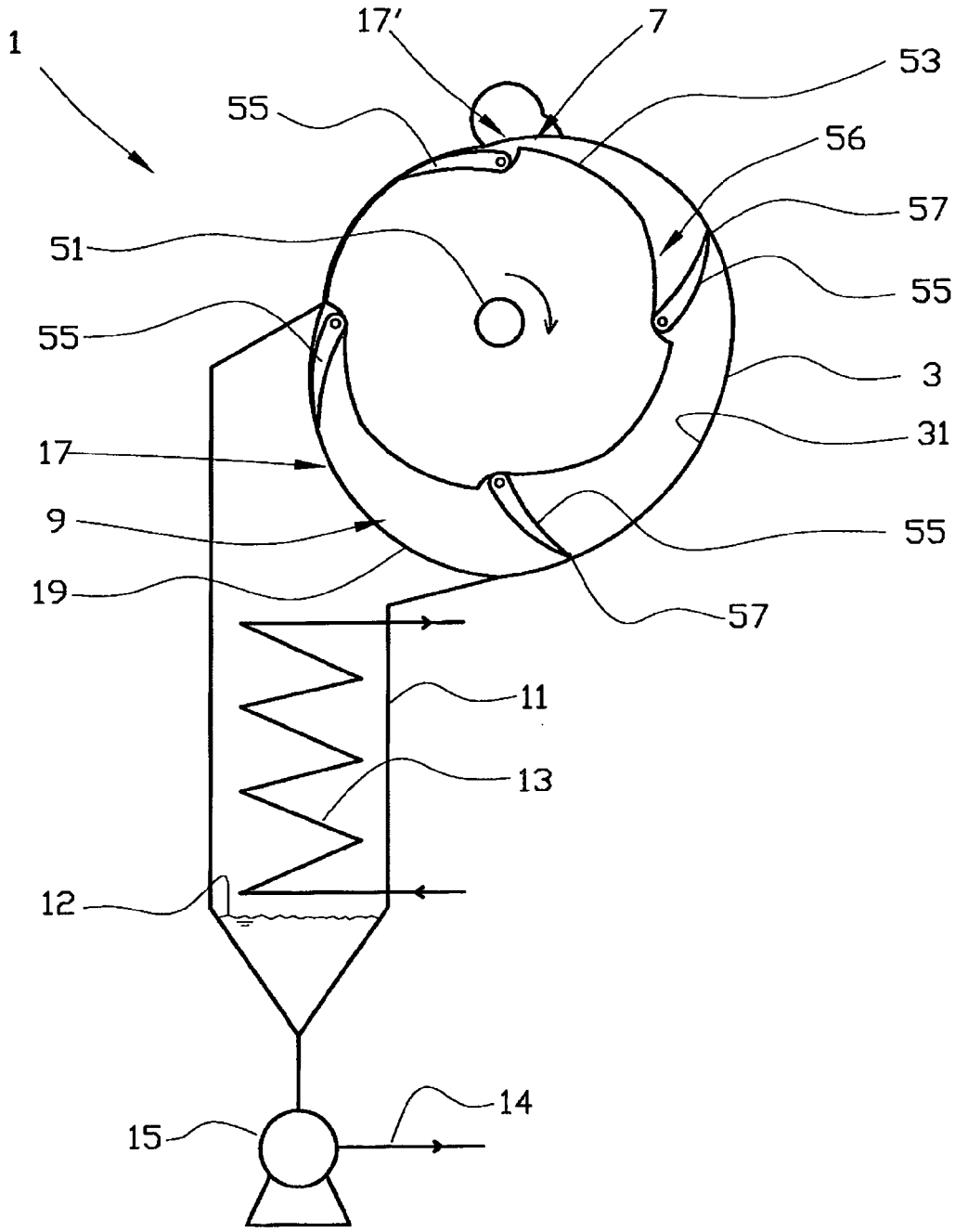
FIG. 8 shows, on a larger scale, the apparatus according to the present invention with an alternative design of the blades.

FIG. 8 shows an apparatus 1 according to the present invention, the apparatus being provided with blades 55 of an alternative embodiment. Instead of letting the blades 55 be moved in and out in the slots 54 of the drum 53 as shown in some of the preceding figures, the blades 55 are hingingly arranged in a portion of the drum 53. The free end portions 57 of the blades 55 are arranged to be moved towards the internal casing surface 31 of the housing 3, for example by means of a biasing element in the form of a spring device (not shown) or a control device of a kind known per se, which is mentioned in the discussions of FIGS. 1 and 2.

In the embodiment shown, the surface of the drum 53 is provided with recesses 56. The recesses 56 are formed to receive and accommodate the blades 55, so that their effective area is approximately zero in an upstream portion of the gas-supply portion 7.

Calculations that have been made show that the apparatus according to the present invention is far more efficient with respect to utilizing the specific energy of the fluid in gas phase carried into the apparatus. This is owing to the fact that the constantly increasing volume of the chambers makes the resultant force on each one of the blades between the gas-supply portion and the exhaust portion contribute all to the rotation of the blade wheel, and that the apparatus is provided with one or more barriers between the gas-supply portion 7 and the exhaust portion 9, said barrier allowing optimization of the underpressure in the condenser and the pull forces of the underpressure while, at the same time, it may be optimized to spend minimal energy on cooling in the condenser.

The invention claimed is:

1. An apparatus (1) for converting a portion of the specific energy of a fluid in gas phase into mechanical work, the apparatus (1) comprising:

at least one housing (3, 3') which is provided with at least one gas-supply portion (7, 7') and at least one exhaust portion (9, 9'), each of the at least one housing (3, 3') comprising;

a blade wheel (5) which is rotatably arranged in the housing (3, 3') and which includes: a shaft (51) enclosed by a drum (53); at least two blades (55) which are movably arranged to the drum (53) so that a portion (57) of the blades (55) is arranged to be moved towards the internal casing surface (31) of the housing (3, 3') in such a way that the drum (53), the internal casing surface (31) of the housing (3) and the blades (55) define chambers (59) arranged to contain gas, wherein an effective area of a blade (55) which is immediately upstream of the exhaust portion (9, 9') is larger than an effective area of a blade (55) which is immediately upstream of the gas-supply portion (7, 7'); the blade wheel (5) constitutes a barrier between the gas-supply portion (7, 7') and the exhaust portion (9, 9'); and the exhaust portion (9, 9') of one of the at least one housing (3, 3') is provided with a condenser (11) to condense the gas which has been carried into the exhaust portion (9, 9'), wherein the apparatus (1) is provided with a control device arranged to control the rotational speed of the blade wheel (5) by means of a load which is connected to the shaft (51) of the blade wheel (5), so that the flow rate of the gas through the apparatus (1) can be adjusted in relationship to the capacity of the condenser (11).

2. The apparatus in accordance with claim 1, wherein the effective area of the blade (55) which is immediately upstream of the gas-supply portion (7, 7') is or is approximately zero.

3. The apparatus in accordance with claim 1, wherein the gas-supply portion (7, 7') is provided with a cam grate arranged to guide the blades (55) in such a way that the effective area of the blade (55) increases gradually through the gas-supply portion (7, 7').

4. The apparatus in accordance with claim 1, wherein the exhaust portion (9, 9') is provided with a cam grate (17) arranged to guide the blade (55) in such a way that the effective area of the blade (55) is reduced gradually through the exhaust portion (9, 9').

5. The apparatus in accordance with claim 1, wherein the effective area of the blades (55) is at its largest when the blades (55) are immediately upstream of the exhaust portion (9, 9') and at its smallest when the blades (55) are in a portion defined by a downstream side of the exhaust portion (9, 9') and the gas-supply portion (7, 7').

6. The apparatus in accordance with claim 1, wherein the effective area of the blades (55) increases continuously from immediately upstream of the gas-supply portion (7, 7') to immediately upstream of the exhaust portion (9, 9').

7. The apparatus in accordance with claim 1, wherein the effective area of the blades (55) increases stepwise from immediately upstream of the gas-supply portion (7, 7') to immediately upstream of the exhaust portion (9, 9').

8. The apparatus in accordance with claim 1, wherein the blades (55) are biased towards the housing (3, 3') and the cam grates (17).

9. The apparatus in accordance with claim 1, wherein a limited portion of the internal casing surface (31) of the housing 3 is provided with a draining device which communicates with the exhaust portion (9, 9') in such a way that any fluid entrained by the blade (55) from the exhaust portion (9, 9') towards the gas-supply portion (7, 7') will be drained back into the exhaust portion (9, 9').

10. The apparatus in accordance with claim 1, wherein the apparatus (1) is provided with a control device arranged to adjust the pressure of the gas which is supplied to the apparatus (1) through the gas-supply portion (7, 7').

11. The apparatus in accordance with claim 1, wherein the apparatus (1) is provided with a temperature controller which is arranged to influence the temperature of the gas which is supplied to the apparatus (1).

12. The apparatus in accordance with claim 1, wherein the apparatus (1) is provided with a controller which is arranged to influence the cooling capacity of the condenser (11).

13. The apparatus in accordance with claim 1, wherein the apparatus (1) is provided with a control algorithm arranged to control an energy production from the apparatus, the control algorithm being arranged to influence one of or a combination of the temperature and/or pressure of the supply gas; the rotational speed of the blade wheel; the cooling capacity of the condenser; the load.

14. The apparatus in accordance with claim 1, wherein the apparatus (1) is provided with a controller for controlling an outlet from the condenser (11) to adjust a liquid level (12) therein, in order thereby to maintain vacuum in the condenser (11).

15. A method of converting a portion of the specific energy of a fluid in gas phase into mechanical work, the method comprising:

supplying an apparatus (1) with a gas through a gas-supply portion (7, 7');

providing a substantially fluidtight, rotating barrier between the gas-supply portion (7, 7') and the exhaust portion (9, 9'); and controlling at least the underpressure in the exhaust portion (9, 9') of the apparatus (1), wherein the underpressure in the exhaust portion (9, 9') of the apparatus (1) is controlled by means of the rotational speed of the rotating barrier in order thereby to adjust the flow rate of the gas through the apparatus (1) to the capacity of a condenser (11) which is arranged for the exhaust portion (9, 9'), and wherein the method includes controlling the rotational speed of the rotating barrier by means of a load.

16. The method in accordance with claim 15, wherein the method further includes adjusting the pressure of the gas which is supplied to the apparatus (1) through the gas-supply portion (7, 7').

17. The method in accordance with claim 15, wherein the method further includes adjusting the temperature of the gas which is supplied to the apparatus (1), so that the temperature of the gas which is carried into the condenser (11) is close to a condensing temperature so that as little energy as possible is spent on heat exchange in the condenser (11).

18. The method in accordance with claim 15, wherein the method further includes adjusting the cooling capacity of the condenser (11).

19. The method in accordance with claim 1, wherein the method further includes controlling an outlet from the condenser (11) to adjust a liquid level (12) therein, in order thereby to maintain vacuum in the condenser (11).

20. The method in accordance with claim 15, wherein the method further includes providing the apparatus with a control algorithm to control the desired energy production from the apparatus, the control including one of or a combination of: the temperature and/or pressure of the supply gas; the rotational speed of the blade wheel; the cooling capacity of the condenser; the load.

* * * * *

UNITED STATES PATENT AND TRADEMARK OFFICE

CERTIFICATE OF CORRECTION

PATENT NO. : 8,813,499 B2
APPLICATION NO. : 13/322645
DATED : August 26, 2014
INVENTOR(S) : Melhus It is certified that error appears in the above-identified patent and that said Letters Patent is hereby corrected as shown below:

In the Claims:
Column 11, Claim 19, Line 1:
Please correct "accordance with claim 1,"
to read -- accordance with claim 15, --

Signed and Sealed this
Third Day of February, 2015

Michelle K. Lee

Michelle K. Lee
*Deputy Director of the United States Patent and Trademark Office*